US006510717B1

(12) United States Patent
Levi

(10) Patent No.: US 6,510,717 B1
(45) Date of Patent: Jan. 28, 2003

(54) STRAP LOCK, A STRAP LOCK BODY FOR A STRAP LOCK, A STRAP FOR A STRAP LOCK AND A STRAP LOCK ASSEMBLY

(76) Inventor: Clark Levi, 3333 Pine Cir., Ocean Springs, MS (US) 39564

( * ) Notice: Subject to any disclaimer, the term of this patent is extended or adjusted under 35 U.S.C. 154(b) by 0 days.

(21) Appl. No.: 09/612,940

(22) Filed: Jul. 10, 2000

(51) Int. Cl.[7] ..... E05B 73/00

(52) U.S. Cl. ..... 70/18; 70/14; 70/30; 70/49; 70/58; 70/164

(58) Field of Search ..... 70/14, 18, 30, 70/49, 58, 164

(56) References Cited

U.S. PATENT DOCUMENTS

| | | | | | |
|---|---|---|---|---|---|
| 598,656 | A | | 2/1898 | De Colton | |
| 1,230,799 | A | | 6/1917 | Scholly | |
| 1,348,960 | A | | 8/1920 | Saegesser | |
| 3,435,642 | A | | 4/1969 | Pesco | |
| 3,765,196 | A | | 10/1973 | Balicki | |
| 3,808,847 | A | | 5/1974 | Vesely | |
| 3,875,771 | A | * | 4/1975 | Reisner | 70/18 |
| 3,959,995 | A | | 6/1976 | Fletcher | |
| 4,019,354 | A | | 4/1977 | O'Dell | |
| 4,382,318 | A | * | 5/1983 | Takimoto | 24/188 |
| 4,494,391 | A | | 1/1985 | Solow | |
| 4,685,315 | A | * | 8/1987 | Comolli | 24/167 |
| 4,768,358 | A | | 9/1988 | Viola et al. | |
| 4,791,236 | A | * | 12/1988 | Klein et al. | 138/166 |
| 4,803,857 | A | | 2/1989 | Hall et al. | |
| 4,932,104 | A | * | 6/1990 | Kowal | 24/170 |
| 4,951,365 | A | * | 8/1990 | Loyd | 24/68 |
| 5,076,531 | A | | 12/1991 | Delaney | |
| 5,177,986 | A | | 1/1993 | Jensen | |
| 5,475,993 | A | | 12/1995 | Kuo | |
| 5,669,253 | A | * | 9/1997 | Higgins | 70/18 |
| 5,692,403 | A | * | 12/1997 | Ling | 70/312 |
| 5,802,888 | A | * | 9/1998 | Parsons | 70/16 |
| 5,873,505 | A | * | 2/1999 | Sovitski | 224/576 |
| 6,044,669 | A | | 4/2000 | Levi | |
| 6,199,412 | B1 | | 3/2001 | Kennedy | |

FOREIGN PATENT DOCUMENTS

| | | | | |
|---|---|---|---|---|
| FR | 2762761 A1 | * | 11/1998 | A45C/13/30 |
| GB | 178 899 | | 4/1922 | |

* cited by examiner

*Primary Examiner*—Michael J. Zanelli
*Assistant Examiner*—Eric M Gibson
(74) *Attorney, Agent, or Firm*—Wenderoth, Lind & Ponack, L.L.P.

(57) ABSTRACT

A strap lock has a flexible strap having a leading end and a trailing end. A locking device includes a first strap engagement portion that is capable of holding one part of the strap in position with respect to the locking device in a lock position thereof, and releasing the one part of the flexible strap in a release position. A second strap engagement portion engages another part of the flexible strap. A lock is capable of locking the first strap engagement portion in the lock position. The strap is preferably woven from strands of metal and high strength polymer.

36 Claims, 10 Drawing Sheets

STRAP LOCK, A STRAP LOCK BODY FOR A STRAP LOCK, A STRAP FOR A STRAP LOCK AND A STRAP LOCK ASSEMBLY

BACKGROUND OF THE INVENTION

1. Field of the Invention

The present invention relates to securing devices used for locking items such as bicycles. In particular, the present invention relates to flexible and variably sized strap-type securing devices, also know as strap locks, which can be used without excess slack so as tightly secure an object so that it will not rattle or disengage from the object.

2. State of the Prior Art

The use of sporting equipment securing devices is well known in the prior art. Sporting equipment securing devices typically consist of a cable type device with loops located at both ends used in conjunction with a padlock, a larger U-shaped lock, or an elastic band used to secure equipment during transport. While these locking devices satisfy the basic objective and requirement of securing one object to another, these devices also possess several drawbacks.

A typical cable type securing device consists of a fixed length cable with a loop located at each end. A padlock is typically passed through each loop and locked to secure the ends. In use, the cable is wrapped around, both, a portion of the sporting equipment, for example a bicycle frame, as well as a locking structure, such as a bicycle rack. The cable is wrapped repeatedly around the bicycle frame and rack until the slack in the cable is eliminated. As the loops are separated by a cable having a fixed length, an exact cable locking length between the frame and the rack is difficult to achieve. Oftentimes, it is impossible to eliminate all of the excess slack. This can prove to be troublesome in situations when a user has secured a bicycle to a rack mounted on an automobile. The excess slack could cause the bicycle to become dislodged from the rack and damaged during transport.

A U-shaped lock has also been used for the purpose of locking sporting equipment. Typically, these devices consist of a heavy U-shaped piece which may be lockingly connected to a straight piece. In use, the bicycle frame is placed proximate a bicycle rack, or perhaps a signpost. Next, the frame and the rack or signpost are encircled on three sides by the, U-shaped piece and on the final side by the straight piece. The two pieces are then locked together. To store the U-shaped lock onto the bicycle, the lock is typically inserted into a separate storing rack attached to the bicycle frame or simply hung over a handlebar. As the lock is not securely attached to the frame, the lock is subject to rattling and may fall off as the bicycle is used. In addition, as the U-shaped lock possesses a relatively small fixed geometric configuration, it cannot serve the purpose of securing sporting equipment to a rack mounted on an automobile. Thus, although the U-shaped lock serves as an anti-theft device, a separate device is required to secure a piece of equipment for transport.

The problem of securing a piece of sporting equipment, without excess slack, to a transport rack has been solved to some extent through the use of elastic bands having engaging hooks located at each end. In use, the elastic band is wrapped around the bicycle frame and the rack and then secured by joining the hooks. The elastic nature of the band allows the user to stretch the band while wrapping around the frame and rack thus eliminating any excess slack. However, these elastic bands are generally easily disengaged and thus fail to serve as an anti-theft device.

Hence, it is apparent that a continuing need exists for a variably sized sporting equipment securing device which is lightweight and which may be exactly sized not only to remove excess slack but also to securely store the device onto the sporting equipment.

SUMMARY OF THE INVENTION

An object of the present invention is to provide a new and improved strap lock which may be variably sized and easily engaged. It is a further object of the present invention to provide a strap lock that can not only tightly engage the object that is being locked, but which is also durable and strong to prevent tampering with the lock.

The objects of the present invention are achieved by the provision of a strap lock which has a flexible strap having a leading end and a trailing end, and a lock device. The lock device has a first strap engagement portion that is capable of holding one part of the strap in position with respect to the lock device in a lock position thereof and releasing the one part of the flexible strap in a release position thereof. A second strap engagement portion of the lock device is provided for engaging another part of the flexible strap. A lock of the lock device is capable of locking the first strap engagement portion in the lock position.

The flexible strap is preferably woven from strands of metal and high strength polymer. Further preferably, the flexible strap has a core of beaded chain. The high strength polymer is preferably Kevlar (poly(p-phenyleneterephtalamide)) or other similar high strength durable polymer. The metal is preferably stainless steel. The strands of metal and high strength polymer are braided together to form the strap around the core.

The second strap engagement portion has a post chamber having a strap slot therein. The strap has a post on the trailing end for receipt in the post chamber. The strap slot is large enough to slidably receive the flexible strap there through, but smaller than the post so as to form a stop for the trailing end of the flexible strap.

The first strap engagement portion preferably comprises a strap receiving channel for slidably receiving the leading end of the strap and a strap holding member that is positioned along the strap receiving channel. The strap holding member is moveably mounted with a pivot member, and the pivot member is pivotally mounted with respect to the lock device to move the holding member between the release position and the lock position. The lock is operable to lock the pivot member when the pivot member moves the holding member to the locked position. Preferably the pivot member comprises engagement holes and the lock member comprises respective engagement pins for engagement with the engagement holes.

According to another feature of the present invention, when the pivot member is at its position with the holding member in the lock position, the pivot member is further positioned to prevent the post from escaping the post chamber.

The strap holding member may comprise a knurled member for engagement with the strap.

The objects of the present invention are further achieved by the provision of a strap for the strap lock as provided above, the strap having the features as described above, particularly including a flexible strap woven from strands of metal and strands of high strength polymer. The objects of the present invention are further achieved by a strap lock body for a strap lock including the first and second strap engagement portions and the lock as described above.

The objects according to the present invention are further achieved by the provision of a plurality of flexible straps with the strap lock, the flexible straps having different lengths so that a different strap can be chosen depending upon the particular usage.

BRIEF DESCRIPTION OF THE DRAWINGS

The strap lock according to the present invention will be described below in detail with reference to preferred embodiments thereof and in conjunction with the attached drawing Figures, in which.

DETAILED DESCRIPTION OF THE PREFERRED EMBODIMENTS

Figure 1:
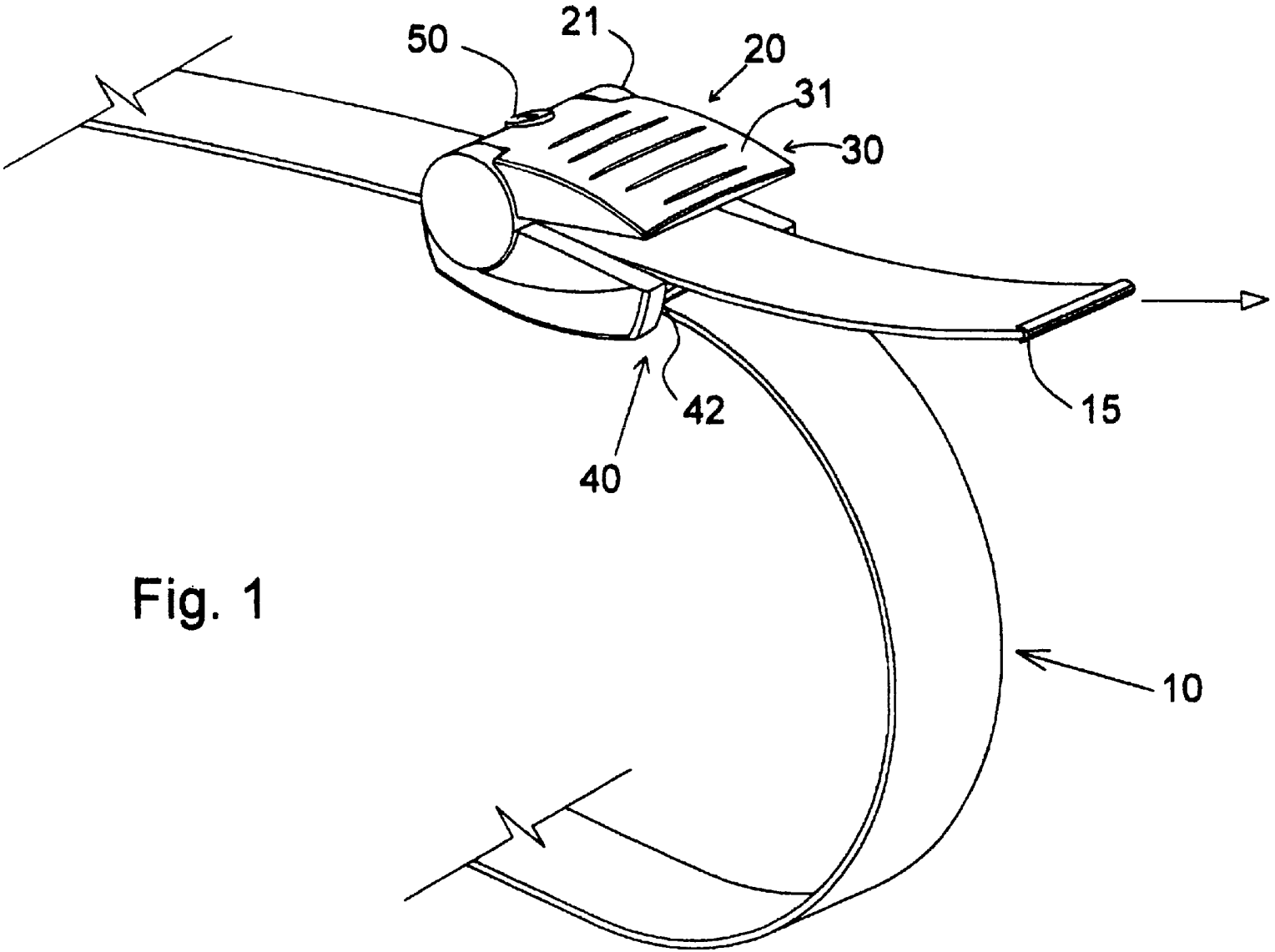
FIG. 1 is a perspective schematic and partly cut away view of a strap lock according to a first embodiment of the present invention.
Figure 2:
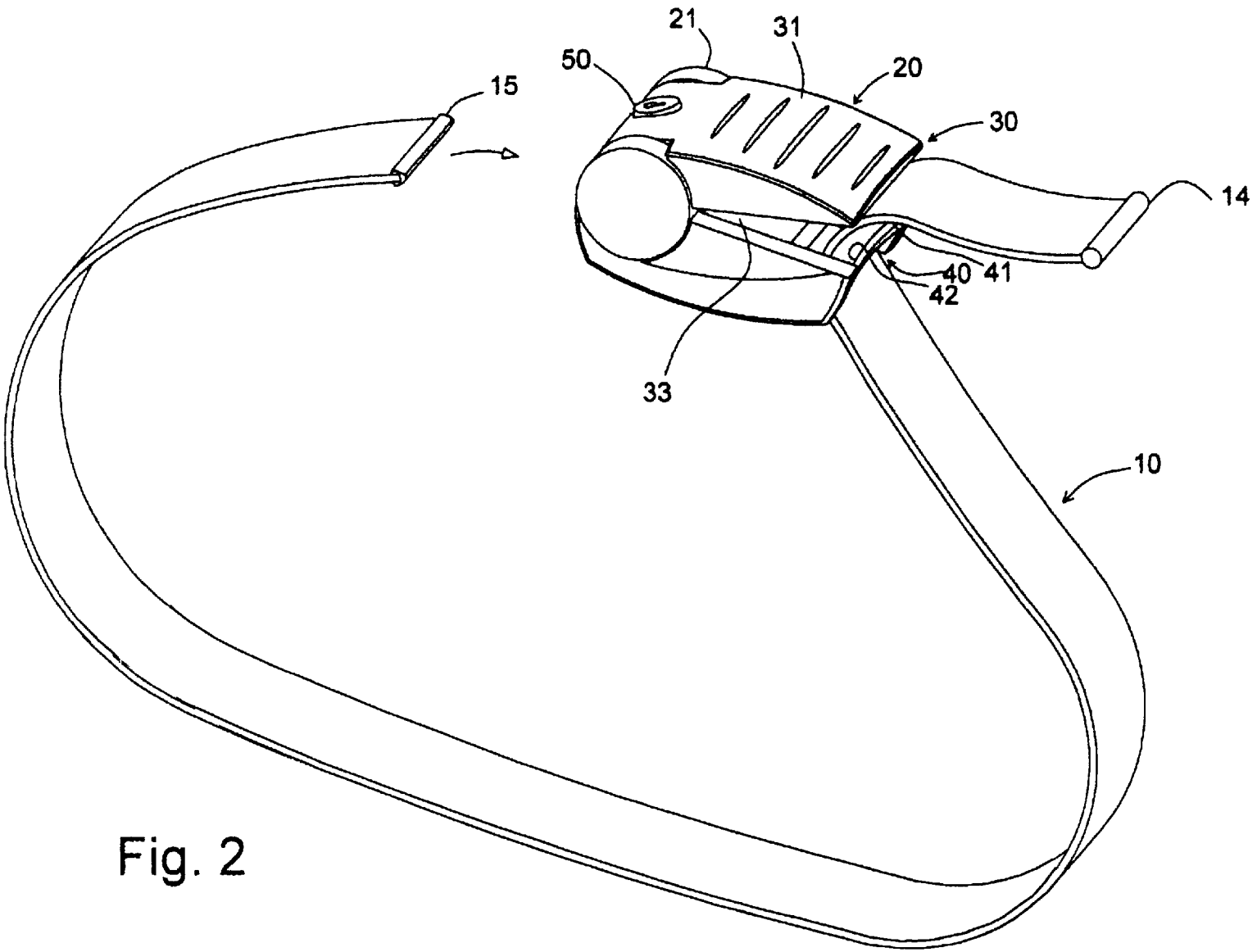
FIG. 2 is a view similar to FIG. 1, showing the strap lock of the first embodiment in the process of assembling the strap lock for use.

Referring first to FIGS. 1–16, a first embodiment of a strap lock according the present invention will be described.

Primary concepts of the present invention involve the use of a flexible but durable strap in locking an object such as a bicycle to another object such as a pole or a bicycle rack. In accordance with an advantageous feature of the present invention, the strap should be able to be tightened so that there is no slack in the strap during use. In accordance with a further feature of the present invention, the strap can be replaced with a longer or shorter strap for use with the same locking device.

The strap lock 1 according to the first embodiment includes a strap 10 for use together with a locking device 20. The locking device 20 includes a lock body 21 which includes a first strap engaging portion 30 and a second strap engaging portion 40. The first strap engaging portion 30 includes a buckle or pivot member 31 that can be pivoted to a closed position (shown for example in FIG. 6) so as to hold the strap 10 in place.

More specifically, a post 14 on an end of the strap 10 is received in a post chamber 41 of the second strap engaging portion 40. The post chamber 41 allows the post 14 to be received therein without going all the way through the second strap engaging portion 40 by the strap 10 having its leading end inserted through a slot 42. The leading end is then continued to be inserted through a channel 33 through the opposite end of the lock body 21.

The leading end of the strap 10 is inserted into the channel 33 while the buckle or pivot member 31 is in its open position and slid through the channel 33 as shown in FIG. 1. The strap 10 is tightened to the appropriate position. The buckle or pivot member 31 is then pushed downward into engagement with the lower part of the lock body 21, which includes the second strap engaging portion 40. The buckle or pivot member 31, together with the lower part of the lock body 21, together form a buckle-type of closure that engages the strap 10 in the closed position to hold it in place. This will explained in more detail.

A lock 50, which can be operated by a key, is positioned at the front end of the lock body 21, being received in the buckle or pivot member 31. After the buckle or pivot member 31 is moved to its closed position, a key can turn the lock to its closed position so that the lock engages the lower part of the lock body 21 to prevent pivotal movement of the buckle or pivot member 31 with respect to the lower part of the lock body 21.

Figure 3:
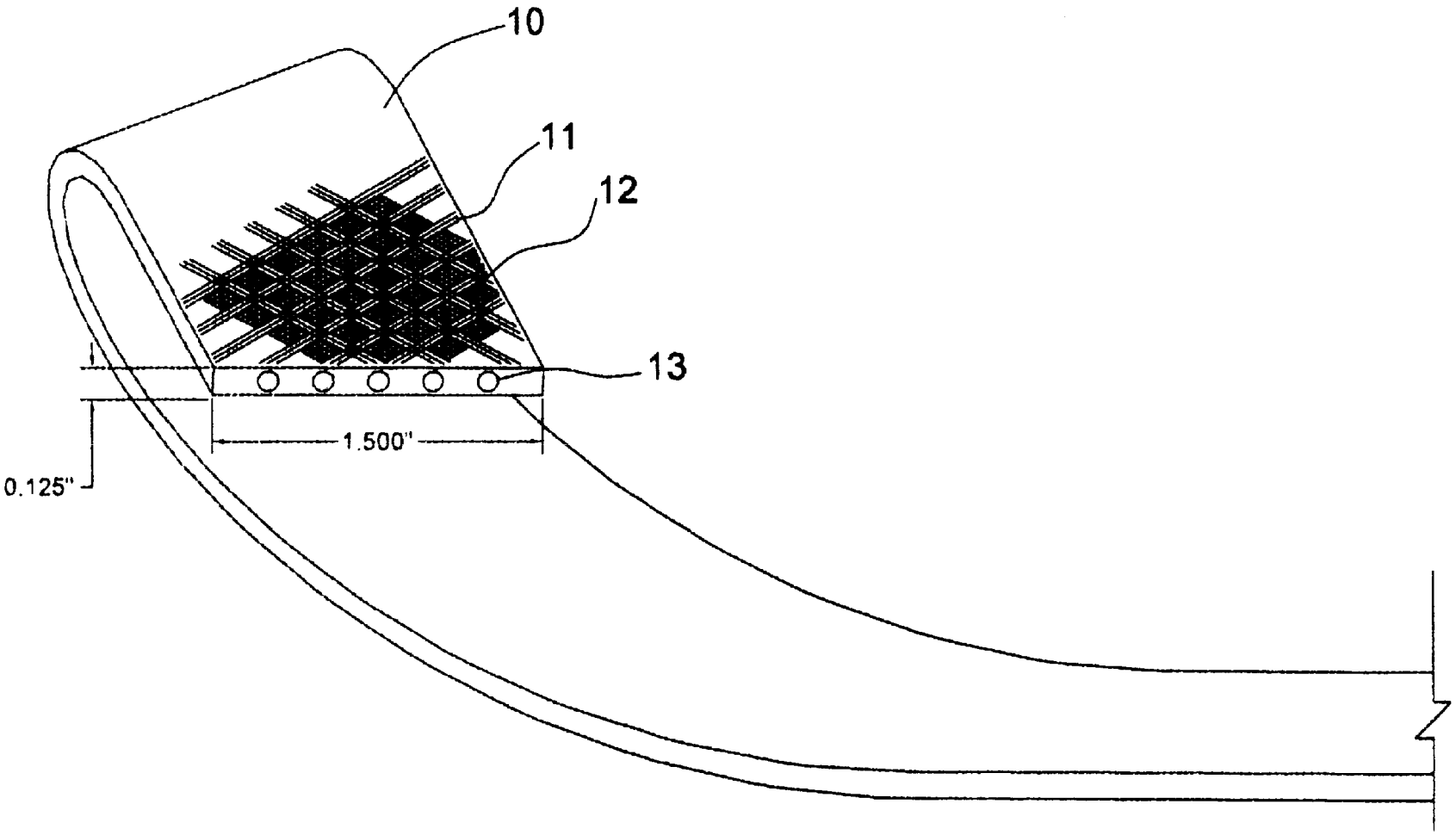
FIG. 3 is a partly perspective and partly cross-sectional view of a strap for use with the strap lock of the first embodiment.
Figure 4:
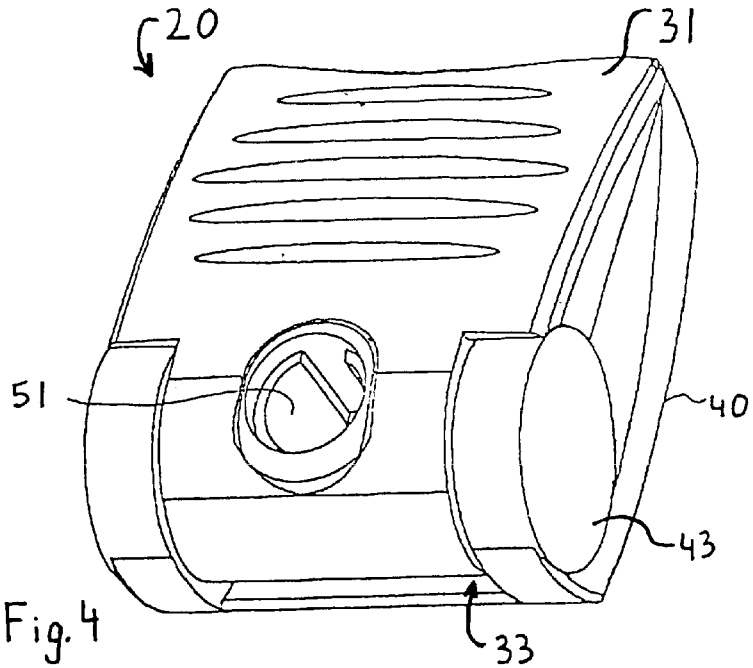
FIG. 4 is a perspective view of a strap lock body for use with a strap lock of the first embodiment.
Figure 7:
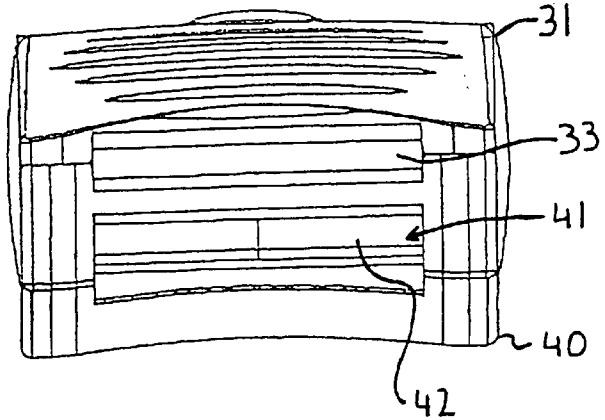
FIG. 7 is a rear end view of the strap lock body of FIG. 4.
Figure 5:
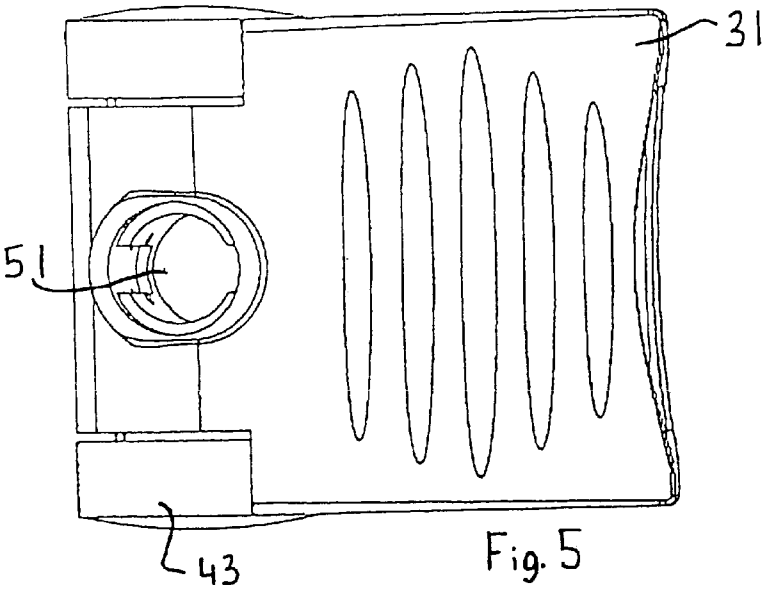
FIG. 5 is a top view of the strap lock body of FIG. 4.
Figure 6:
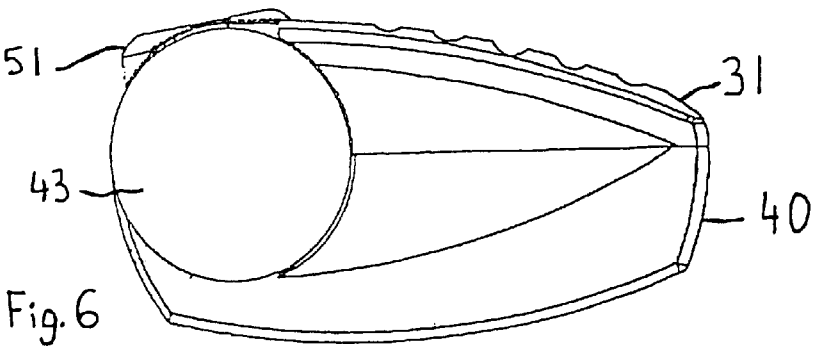
FIG. 6 is a side view of the strap lock body of FIG. 4.
Figure 8:
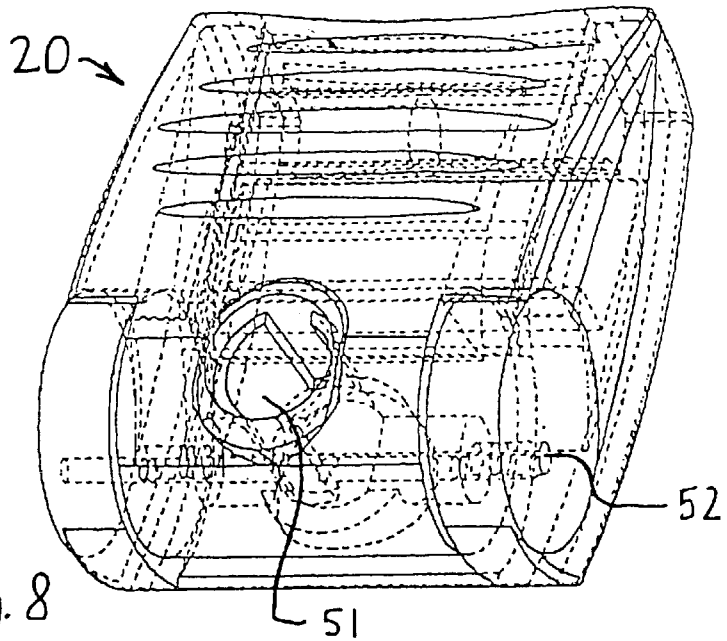
FIGS. 8–11 are views of the strap lock body of the first embodiment similar to FIGS. 4–7, showing with broken lines various details of the strap lock body.
Figure 11:
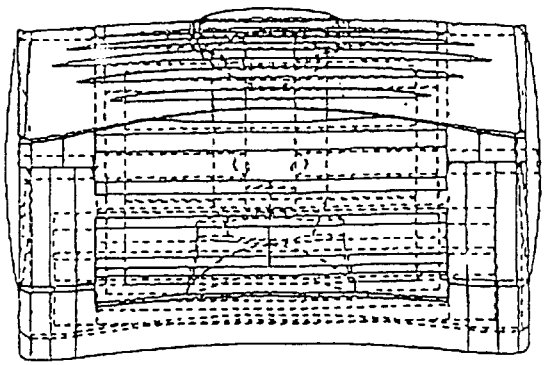

Turning to FIG. 3, the strap 10, according to a further preferred feature of the present invention, is a woven strap made from a combination of metal and plastic materials. Preferably, steel strands 11 are woven with plastic strands 12 to form a woven mesh-like braid. Further preferably, the steel strands 11 and the plastic strands 12 are woven about a core 13.

Weaving a plastic together with steel provides a strength greater than that of the plastic by itself. Further, the plastic material makes it more difficult for someone to cut through the steel strands or wires. That is, if someone were trying to cut the strap 10 with a set of cable cutters, the plastic that is integrated with the steel will allow the steel to give a small amount, thus not allowing the strap to be cut through with the cable cutters. If someone attempts to cut the strap 10 with shears, the steel tends to cause the shears to bind.

The plastic and steel woven together forms an outer layer or crust having the core 13. The steel and plastic can be woven together on an appropriate loom so as form a tight mesh while still providing the strap with flexibility and great durability.

The plastic is preferably a high quality and high strength polymer material, and further preferably Kevlar.

The steel strands 11 preferably comprise stainless steel.

The core 13 is preferably a solid metal, and is more preferably a beaded chain. Employing a beaded chain as the core 13, extending axially through the strap and surrounded by the mesh of the woven stainless steel wires and Kevlar wires, for example, allows the strap 10 to remain flexible while further allowing the strap material to have memory. Furthermore, the steel in the plastic and steel weave of the strap 10 forms a bridge between respective balls of the beaded chain in the core 13. This allows the pressure from cutting tools trying to cut the strap 10 to be forced onto the tops of the balls of the beaded chain, instead of into areas in between the balls of the beaded chain. The presence of a beaded chain having such balls in the center of the woven strap 10 makes the strap 10 significantly stronger than without the beaded chain.

Alternatively, instead of a beaded chain, the core 13 could comprise a plain steel mesh. In this instance, it is possible to consider that a similar steel and plastic woven mesh as described above would surround this core, or, possibly just a plastic woven mesh could be provided over the outside of the steel mesh.

In addition to looming or weaving the mesh around the core 13, plastic material for the strap 10 could be injection molded around a steel mesh or solid metal material by placing such metal material within a mold and then injecting the plastic material so as to be formed around the metal material.

The core 13 may also comprise a beaded chain where the beaded chain is a mid gauge "13" beaded chain made of nickel plated stainless steel. It can also be brass covered. One advantage of employing beaded chain is the relative low cost of beaded chain.

According to one example of the strap 10 for use of each of the embodiments disclosed herein, the strap 10 includes 10 strands of 0.01 inch stainless steel, three cords wrapped three times of Kevlar braid, and a core 13 of beaded chain. The Kevlar material is designated 24×3×1500 denier, while the stainless steel material is designated 24×11×30.

The post 14 is preferably made of an aluminum material crimped onto the end of the strap 10. A filler material such as a liquid cement may be included to make sure that there is a solid and complete connection between the post 14 and the strap 10. A similar flat front piece 15 is crimped on to the front end of the strap 10 for insertion through the lock body 21.

The lock body 21 of the locking device 20 includes the first strap engaging portion 30 having the buckle and pivot member 31 and the second strap engaging portion 40 on the lower part of the lock body 21. The lock 50 is provided separately. However, the remainder of the lock body 21 can be formed of cast steel or molded from a synthetic material. Preferably, it is made from a hard plastic material chosen for strength and durability.

Figure 9:
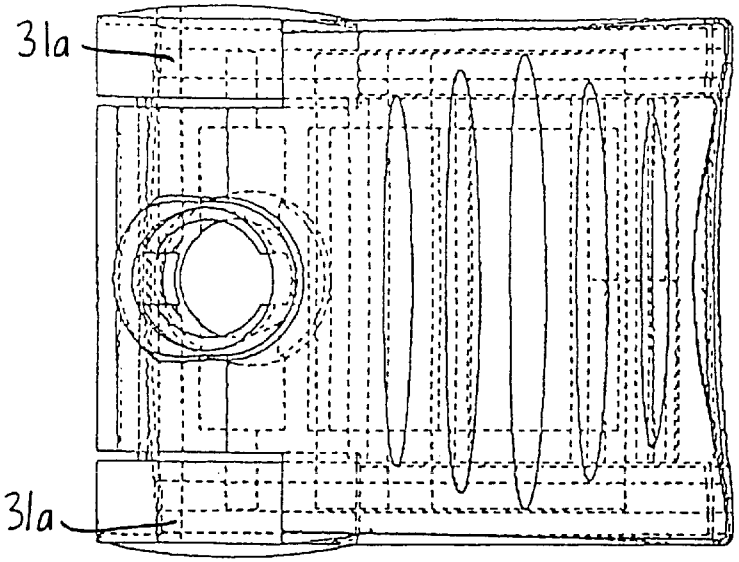
Figure 10:
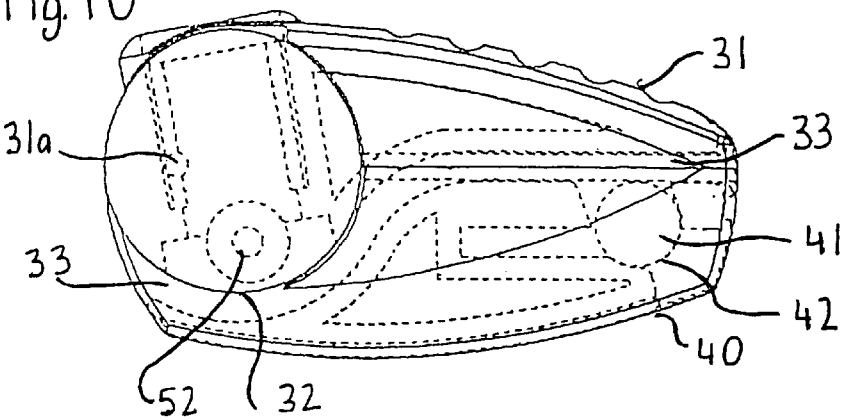
Figure 12:
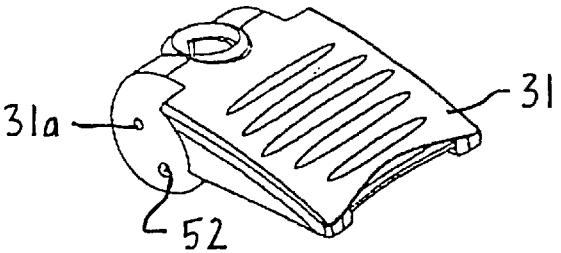
FIG. 12 is a perspective view of a buckle/pivot member of the strap lock body of the first embodiment.
Figure 14:
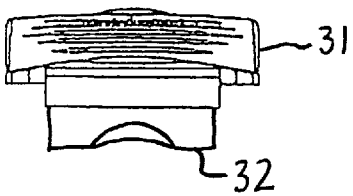
FIGS. 13–15 are side, rear-end and top views, respectively, of the buckle/pivot member of FIG. 12.
Figure 15:
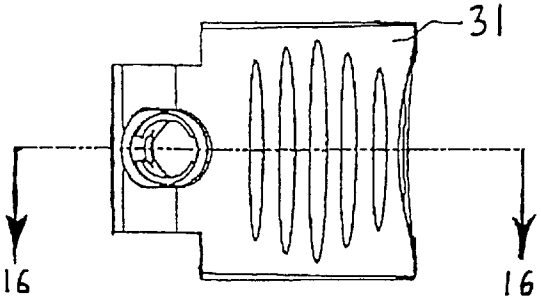
Figure 13:
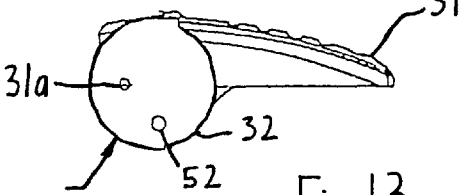

Turning now to FIGS. 4–16 details of the lock body 21 and its interaction with the lock 50 will be discussed. The buckle or pivot member 31 is pivoted at a pivot point 31*a* which is best illustrated by FIGS. 9 and 10. The pivot point 31*a* is a point at which the buckle or pivot member 31 is pivoted to the lower part of the lock body 21. Pivots 43, the large round portions on the front end of the lock body 21, are part of the lower portion of the lock body 21, and it is to these pivots 43 that the buckle or pivot member 31 is pivoted. As can be seen in FIG. 9, a suitable pivot shaft or shafts will extend from the interior of the end of the buckle or pivot member 31 to the interior of the pivots 43 to allow the buckle or pivot member 31 to pivot thereon.

A lock slot 51 is provided in the buckle or pivot member 31 at the front end for purposes of receiving the lock 50. The lock 50 is, according to this embodiment, a key lock which includes projecting pins for engagement with lock pin slots 52 in the pivots 43. Accordingly, when the lock 50 is in the unlocked position and the key in the lock is turned, the pins thereof will project outwardly from the lock 50 into engagement with the lock pin slots 52 so as to engage the buckle/pivot member 31 with the pivots 43 of the lower portion of the lock body 21. This prevents pivotal movement of the buckle or pivot member 31 with respect to the lower portion, thereby locking the buckle and pivot member 31 in place.

Accordingly, when an object is to be locked to another object, the leading end piece 15 is inserted through the post chamber 31 and the slot 42 until the post 14 is received in the post chamber 41. As can be seen from FIG. 10, there is room via the slot 42 for the post 14 to pivot through a number of different angles to allow the strap 10 to take a number of different positions according to the use.

The piece 15 on the end of the strap 10 is then inserted into the channel 33 as shown in FIG. 10. The buckle or pivot member 31, in the open position, is raised to allow the strap 10 to be received through the channel 33 and out the right side above the post chamber 41, as can be partly seen from FIG. 10 and as further illustrated in FIG. 1. After the strap 10 has been tightened the appropriate amount, the buckle or pivot member 31 is closed to bring a holding member 32 into engagement with the strap to hold the strap between the holding member 32 and the lower portion of the lock body 21. The holding member 32 can include a number of different arrangements. According to a preferred feature, it is includes a knurled surface that clamps the strap 10 against a similar knurled surface opposite thereto to firmly hold the strap 10 in place inside the lock body 21 in the closed position of the buckle or pivot member 31.

After the buckle or pivot member 31 has reached the closed position and the holding member 32 has engaged the strap 10 to hold the strap 10 in the channel 33 by friction contact or otherwise, a key is turned in the lock 50 to engage the pins of the lock 50 with the lock pin slots 52. At this point, then, the strap lock is in the lock position. Any leftover portion of the strap 10 will jut out of the right-hand side (as seen in FIG. 1) of the lock body 21 above the post chamber 41. Further, in the closed position the buckle or pivot member 31 closes down above the post chamber 41, preventing the post 14 from becoming removed therefrom. Note for example, FIG. 10.

According to a further preferred feature of the present invention, a plurality of straps 10 can be provided with a single locking device 20. The different straps 10 can have different lengths so that a different length may be chosen depending upon the intended use.

Figure 16:
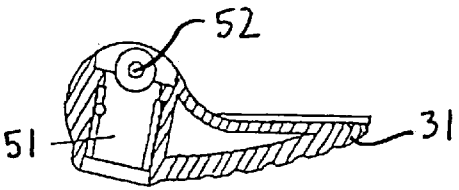
FIG. 16 is a cross-sectional view taken along lines 16—16 of FIG. 15.
Figure 16B:
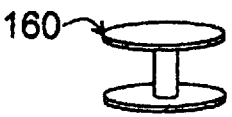
FIG. 16B is a round clip for use with a strap of FIG. 16A.
Figure 16C:
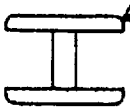
FIG. 16C is a straight clip for use with the strap of FIG. 16A.
Figure 16A:
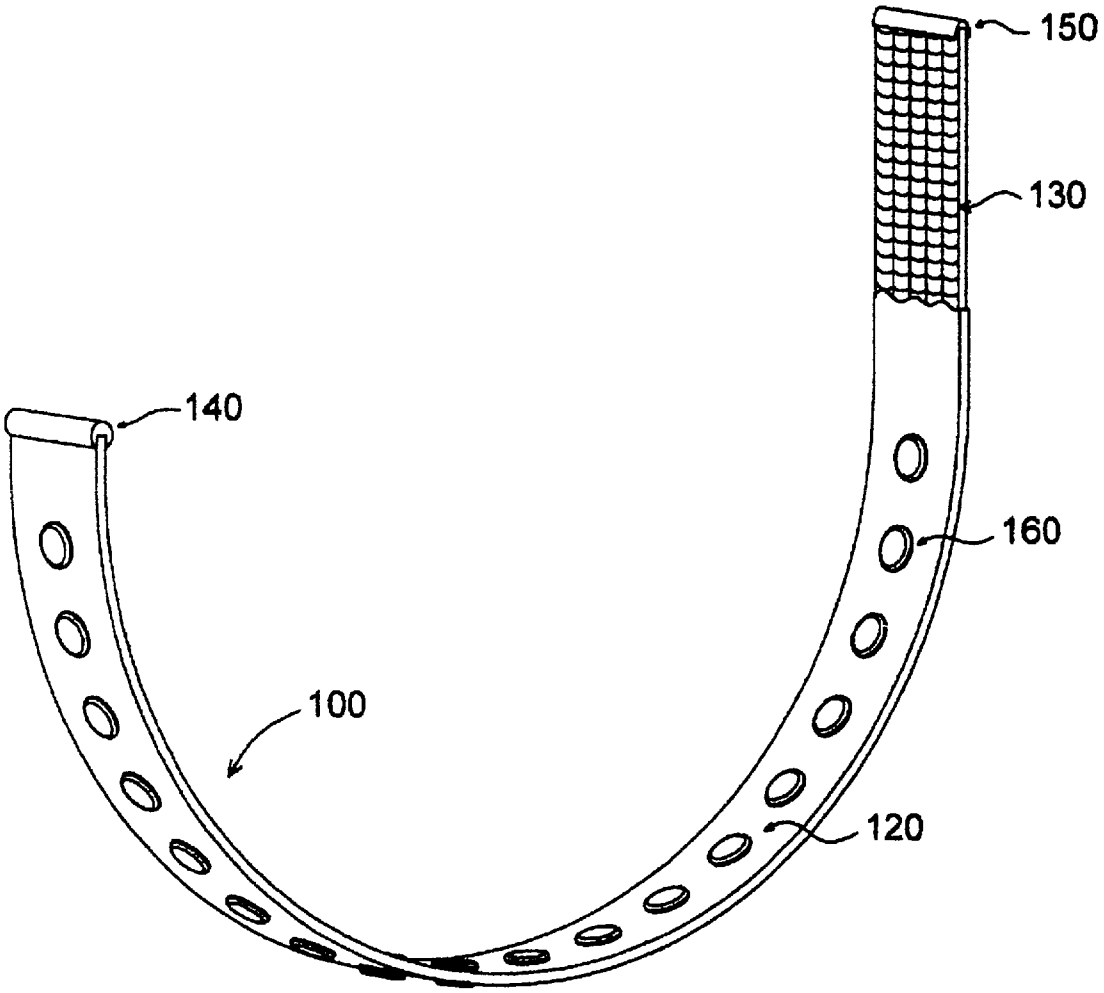
FIG. 16A is a perspective view, partially broken away, of a strap for use with the present invention.

A modified version of the strap according to the present invention can be seen from FIG. 16A. This version of the strap can be used with the various embodiments of the strap lock according to the present invention. In this version of the strap, a strap 100 includes a core 130 surrounded by a covering 120. The core 130 is chainmail and the covering 120 is a polysynthetic covering. The polysynthetic covering is preferably tightly woven in order to maintain conformity with the chainmail core.

Clips 160 can be provided along the strap 100 to maintain the integrity of the strap and to prevent relative movement between the covering 120 and the core 130. A flat front piece 150 is on one end of the strap, and a post 140 is on the other end of the strap, similar to the other embodiments.

The clip 160 is round, as shown in FIG. 16B, but can also be straight, as shown in FIG. 16C. The clip extends from one side of the strap to the other, as illustrated in FIG. 16A, and thus sandwiches the layers between the ends of the clip and holds them in place relative to each other.

The strap for any of the embodiments described herein can include clips at each end, and also along the length of the strap, as necessary. One strap employing these types of clips could include a core consisting of cables that are laid flat, and a cover made of Kevlar braid covering the cables.

A preferred way of incorporating the chainmail core 130 into the strap will now be described by way of example. A two inch wide strip of chainmnail that is about 20 feet long is used together with a 20 foot long piece of thin metal. The piece of thin metal should be a flat band about ¾ to one inch wide. The chainmnail is folded around the flat band to envelop the band, forming a C shape with the band in the center of the C. The open part of the C formed by the chainmail should be along the middle of the band, i.e. between the edges of the flat band along one side thereof. The chainmail is then secured to the band with rubber bands or anything similar that will secure the chainmail and prevent the chainmail from sliding, off of the band during, handling. After these steps are completed, the band covered with the chainmail is fed into a weaving machine, and the polysynthetic covering (e.g. Kevlar) is woven around the chainmail core. When the end of the 20 foot length of the band is reached, the band is simply pulled out of the chainmail core, and the chainmail then stays in place inside of the woven covering, thus forming the completed strap. The use to the band during manufacture helps to keep the chainmail from bunching inside of the strap. Clips can be placed on the finished strap to ensure the flatness of the strap, and to keep the chainmail from sliding.

A further feature that can be incorporated into the strap of each of the embodiments described herein include elongated, perhaps cylindrical, structures placed along the middle of the strap, that is, from one side of the strap toward the other, so as to provide ridges or raised portions along the strap. Such ridges or raised portions would help to keep the strap from slipping in the locked mode, because the respective raised portions would encounter greater resistance in slipping through the lock body. The structures could be simple elongated members tapered at their ends to provide appropriate ridges that extend transversely of the strap, spaced from each other in the longitudinal direction of the strap.

In a further variation of the present invention, the lock could have a number of different arrangements. As described above, the lock is a key lock in which actuation of the key projects pins outwardly of the lock to engage and lock the respective pivoting members. Alternatively, the lock could be of a push and lock type. In this type, the lock is activated by pushing a button or other suitable member to cause spring-loaded or otherwise actuatable pins to engage and lock the respective pivoting members. Subsequent unlocking by, for example, a key, would result in the pins then being retracted. Another type of lock could work similarly to a garage door handle; that is, a handle member could be turned to cause respective link members to either project or retract the pins for locking the respective pivoting members, with the handle member being capable of being locked in place with the pins projecting. These types of locks are generally known.

Figure 17:
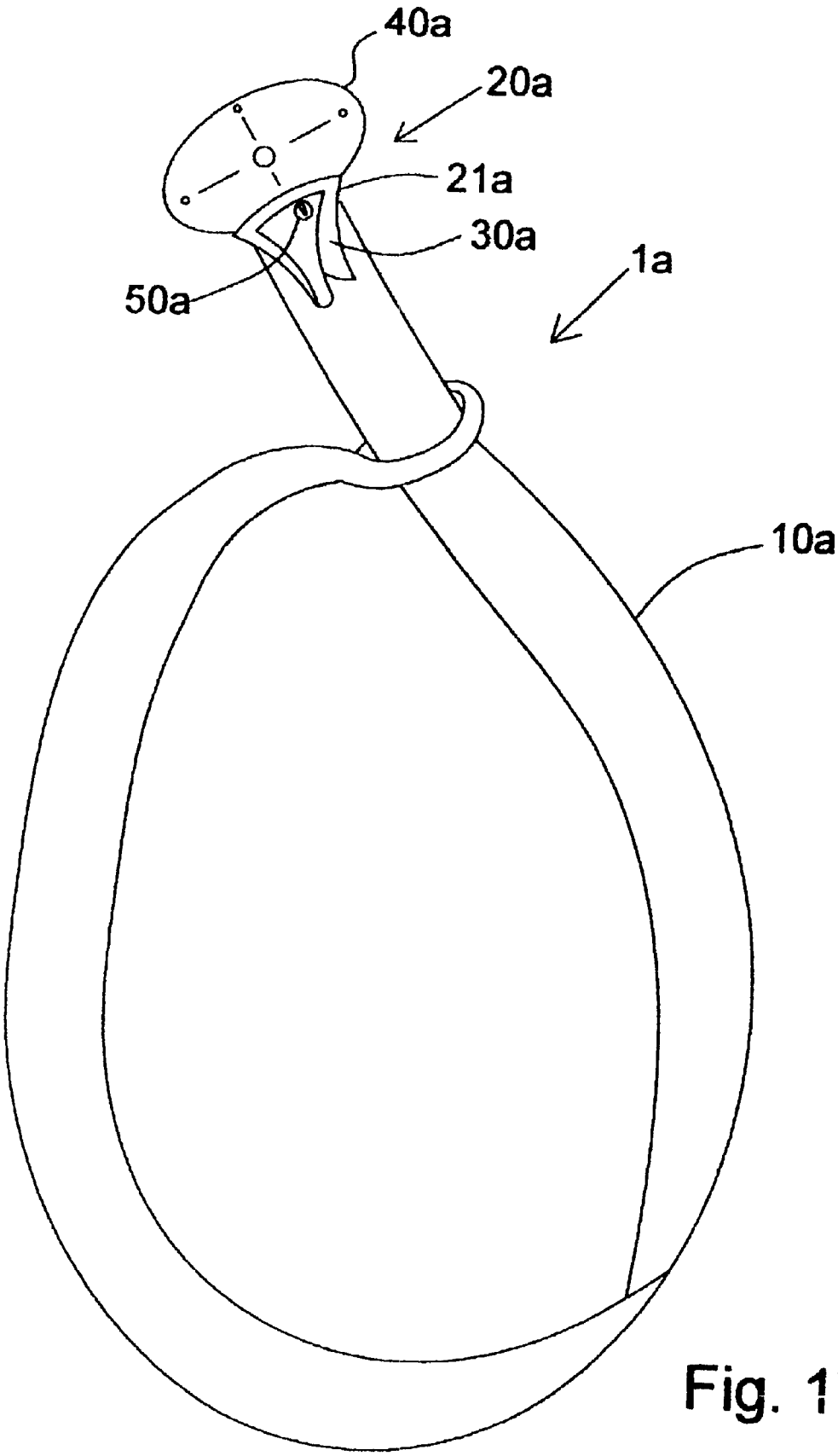
FIG. 17 is a perspective view of a second embodiment of a strap lock according the present invention.
Figure 18:
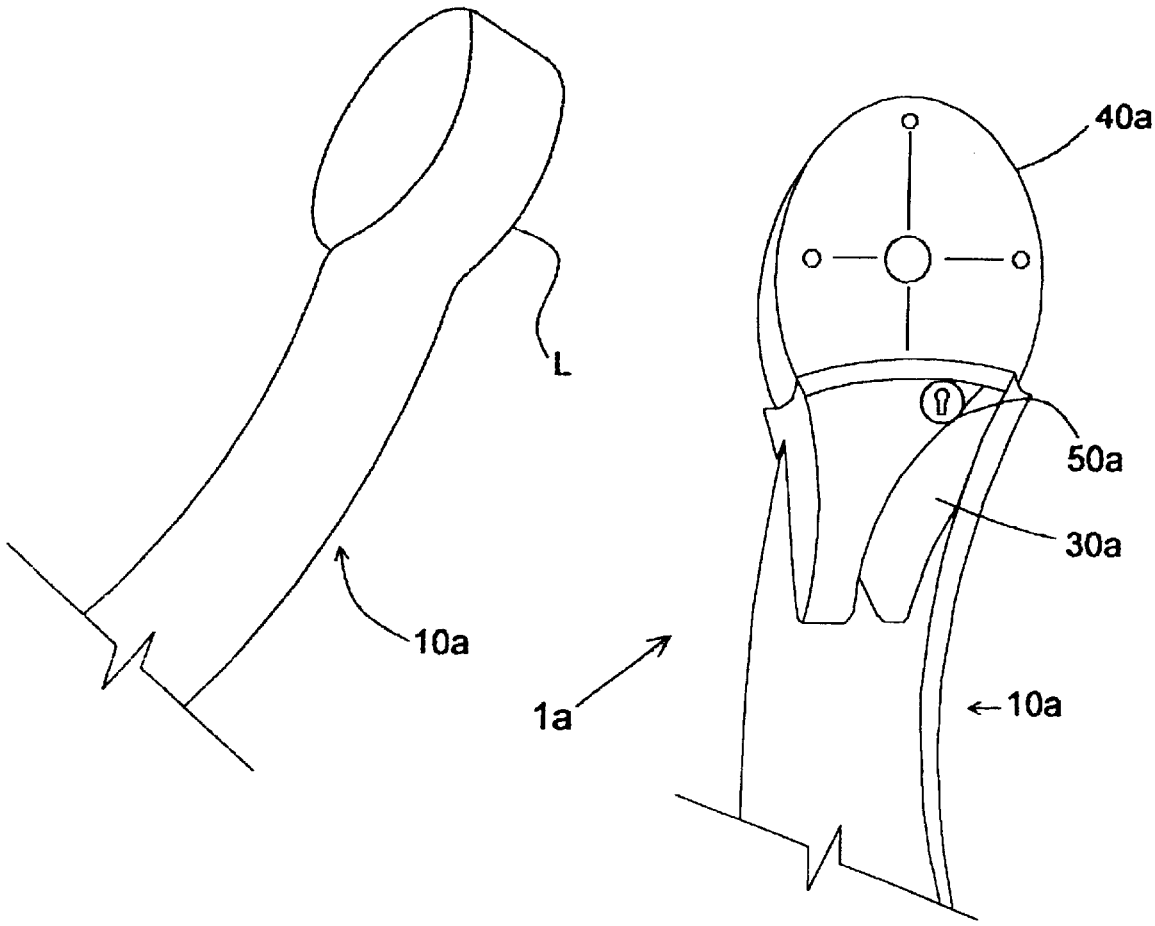
FIG. 18 is a partially cut-away perspective view of the strap lock according to the second embodiment in an unlocked position.

FIGS. 17 and 18 illustrate a second embodiment of the present invention. This embodiment employs a strap 10*a* that is similar in construction to the strap 10 described above. Accordingly, only differences between the strap 10*a* and the strap 10 described above will be noted at this point.

The strap 10*a* of this second embodiment includes an end having a loop L. The loop may be formed by connecting an end of the strap 10*a* to itself at a point spaced toward the rear end of the strap 10*a*. Such connection may be made a number of different ways, such as weaving the two portions of the strap together, riveting the two sections together or otherwise employing appropriate steel or other wire to bind the two portions together. However, it is important that the connection forming the loop L be sufficiently strong to prevent the loop L from coming apart even under a strong pull.

The other end of the strap 10*a* has a locking device 20*a* connected thereto. The locking device 20*a* includes a lock body 21*a* which includes a strap engaging portion 30*a* and a lock 50*a*. The strap engaging portion 30*a* can be crimped on or otherwise appropriately attached to the end of the strap 10*a*.

The locking device 20*a* further includes a strap removal preventing member 40*a* that is movably mounted on the strap engaging portion 30*a*. The lock 50*a* is operable to lock the strap removal preventing portion 40*a* in position in either the position shown in FIG. 17 or the position FIG. 18. Accordingly, a loop can be formed with the strap 10 as shown in FIG. 17 by slipping the loop L over the end of the strap removal preventing portion 40*a* when in the position shown by FIG. 18 so that the loop L is slipped around its strap 10*a*. The strap removal preventing portion 40*a* is then moved or pivoted to the position as shown in FIG. 17, and the lock 50*a* is locked to prevent its further movement. The oblong shape of the strap removal preventing portion 40*a*, in the position of FIG. 17, prevents the loop L from coming back off of the strap 10*a*.

Figure 20:
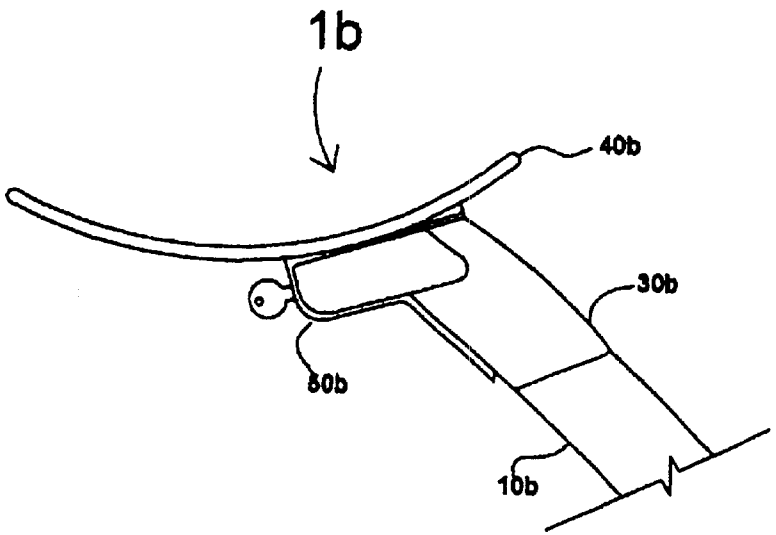
FIG. 20 is a view similar to FIG. 19 showing an unlocked position.
Figure 19:
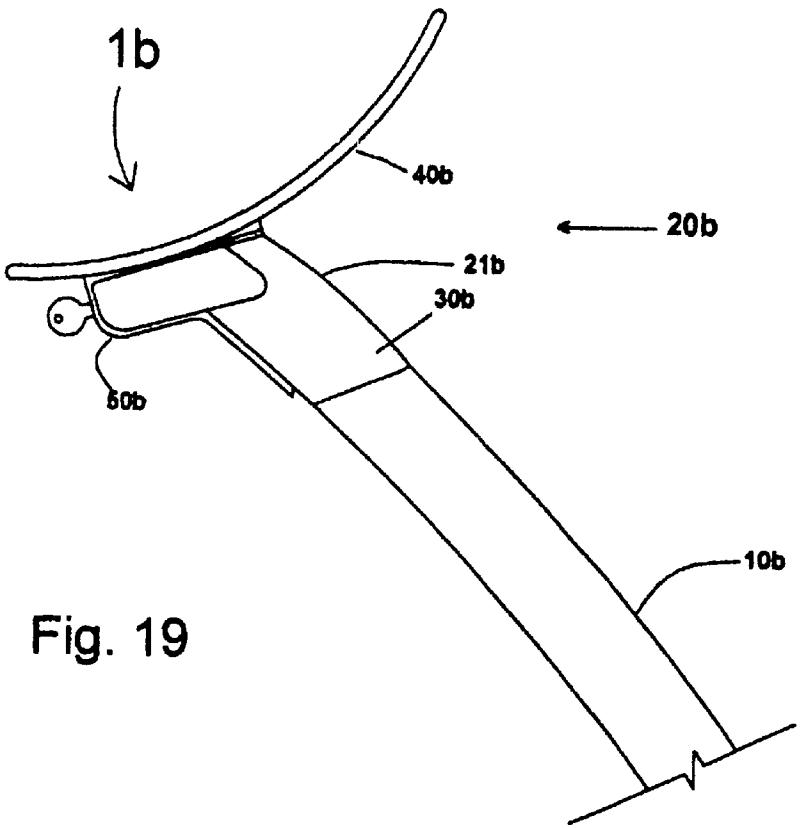
FIG. 19 is a side view of a strap lock according to a third embodiment of the present invention illustrating a locked position.

FIGS. 19 and 20 illustrate an embodiment similar to that of FIGS. 17 and 18. Reference numbers 1*b*, 10*b*, 20*b*, 21*b*, 30*b*, 40*b* and 50*b* correspond to references numbers 1*a*, 10*a*, 20*a*, 21*a*, 30*a*, 40*a* and 50*a*, respectively. The differences between these two embodiments will be discussed.

In FIGS. 19 and 20, the strap 10*b* is similar to the strap 10*a* in employing a loop L in the same way as the embodiment of FIGS. 17 and 18. However, in this embodiment the strap removal preventing member 40*b* is elongated member that is rotated on top of the lock body 21*b* of the locking device 20*b*. In the rotated position of FIG. 20, the loop L can be slipped over the end of the strap 10*b*, wherein in the position of FIG. 19, the loop L is prevented from being slipped on or off of the strap 10*b*.

The strap removal preventing member 40*b* rotates about an axis lying in the plane of the paper that is generally perpendicular to the lock 50*b*.

While preferred embodiments of the present invention have been described above, it will be apparent to those of ordinary skill in the art that various changes to the specific thereof may be made within the scope of the present invention.

I claim:

1. A strap lock, comprising:

a flexible strap having a leading end and a trailing end; and a lock device comprising a first strap engagement portion capable of holding one part of said strap at the leading end thereof in position with respect to said lock device in a locked position thereof and releasing the one part of said flexible strap in a release position thereof, a second strap engagement portion for engaging another part of said flexible strap at the trailing end thereof, and a lock capable of locking said first strap engagement portion in the locked position;

wherein said second strap engagement portion releasably holds the other part of said flexible strap such that, when said first strap engagement portion is in the locked position with the other part of said flexible strap held by said second strap engagement portion, the other part of said flexible strap cannot be removed from said second strap engagement portion.

2. The strap lock of claim 1, wherein said flexible strap is woven from strands of metal and strands of a high strength polymer.

3. The strap lock of claim 2, wherein said flexible strap further comprises a core of beaded chain.

4. The strap lock of claim 2, wherein said high strength polymer comprises Kevlar.

5. The strap lock of claim 4, wherein said metal comprises stainless steel.

6. The strap lock of claim 2, wherein said metal comprises stainless steel.

7. The strap lock of claim 2, wherein said strands of metal and said strands of high strength polymer are braided together.

8. The strap lock of claim 1, wherein said first strap engagement portion comprises a strap receiving channel for slidably receiving said leading end of said strap and a strap holding member positioned along said strap receiving channel.

9. The strap lock of claim 1, wherein said flexible strap comprises a chainmail core having a polysynthetic covering.

10. The strap lock of claim 9, wherein said polysynthetic covering is tightly woven so as to maintain conformity with said chainmail core.

11. A strap lock, comprising:

a flexible strap having a leading end and a trailing end; and a lock device comprising a first strap engagement portion capable of holding one part of said strap in position with respect to said lock device in a locked position thereof and releasing the one part of said flexible strap in a release position thereof, a second strap engagement portion for engaging another part of said flexible strap, and a lock capable of locking said first strap engagement portion in the locked position;

wherein said second strap engagement portion comprises a post chamber having a strap slot therein and said strap has a post on said trailing end for receipt in said post chamber, said strap slot being large enough to slidably receive said flexible strap there through and smaller than said post so as to form a stop for said trailing end of said flexible strap.

12. The strap lock of claim 11, wherein said first strap engagement portion comprises a strap receiving channel for slidably receiving said leading end of said strap and a strap holding member positioned along said strap receiving channel.

13. The strap lock of claim 12, wherein said strap holding member is movably mounted with a pivot member and said pivot member is pivotally mounted with respect to said lock device to move said holding member between said release position and said locked position.

14. The strap lock of claim 13, wherein said lock is operable to lock said pivot member when said pivot member moves said holding member to said locked position.

15. The strap lock of claim 14, wherein said pivot member comprises engagement holes and said lock comprises respective engagement pins for engagement with said engagement holes.

16. The strap lock of claim 13, wherein said pivot member, when said holding member is in said locked position, is positioned to prevent said post from escaping said post chamber.

17. A strap lock, comprising:

a flexible strap having a leading end and a trailing end; and a lock device comprising a first strap engagement portion capable of holding one part of said strap in position with respect to said lock device in a locked position thereof and releasing the one part of said flexible strap in a release position thereof, a second strap engagement portion for engaging another part of said flexible strap, and a lock capable of locking said first strap engagement portion in the locked position;

wherein said first strap engagement portion comprises a strap receiving channel for slidably receiving said leading end of said strap and a strap holding member positioned along said strap receiving channel; and wherein said strap holding member is movably mounted with a pivot member and said pivot member is pivotally mounted with respect to said lock device to move said holding member between said release position and said locked position.

18. The strap lock of claim 17, wherein said lock is operable to lock said pivot member when said pivot member moves said holding member to said locked position.

19. The strap lock of claim 18, wherein said pivot member comprises engagement holes and said lock comprises respective engagement pins for engagement with said engagement holes.

20. The strap lock of claim 17, wherein said strap holding member comprises a knurled member.

21. A strap for a strap lock, comprising a flexible strap having a leading end and a trailing end and woven from strands of metal and strands of a high strength polymer, wherein said strap has a post on said trailing end for receipt in a post chamber of a strap lock.

22. A strap lock body for a strap lock, comprising:

a first strap engagement portion capable of holding one part of a strap in position with respect to said first strap engagement portion in a locked position thereof and releasing the one part of the flexible strap in a release position thereof;

a second strap engagement portion connected to said first strap engagement portion for releasably engaging another part of the flexible strap so that the other part of the flexible strap can be engaged and released; and a lock capable of locking said first strap engagement portion in the locked position.

23. The strap lock body of claim 22, wherein said first strap engagement portion comprises a strap receiving channel for slidably receiving said leading end of said strap and a strap holding member positioned along said strap receiving channel.

24. The strap lock body of claim 23, wherein said strap holding member is movably mounted with a pivot member and said pivot member is pivotally mounted with respect to said lock to move said holding member between said release position and said locked position.

25. The strap lock body of claim 24, wherein said lock is operable to lock said pivot member when said pivot member moves said holding member to said locked position.

26. The strap lock body of claim 25, wherein said pivot member comprises engagement holes and said lock comprises respective engagement pins for engagement with said engagement holes.

27. The strap lock body of claim 23, wherein said strap holding member comprises a knurled member.

28. A strap lock body for a strap lock, comprising:

a first strap engagement portion capable of holding one part of a strap in position with respect to said first strap engagement portion in a locked position thereof and releasing the one part of the flexible strap in a release position thereof;

a second strap engagement portion connected to said first strap engagement portion for engaging another part of the flexible strap; and a lock capable of locking said first strap engagement portion in the locked position;

wherein second strap engagement portion comprises a post chamber having a strap slot therein and said strap has a post on said trailing end for receipt in said post chamber, said strap slot being large enough to slidably receive said flexible strap there through and smaller than said post so as to form a stop for said trailing end of said flexible strap.

29. The strap lock body of claim 28, wherein said first strap engagement portion comprises a strap receiving channel for slidably receiving said leading end of said strap and a strap holding member positioned along said strap receiving channel.

30. The strap lock body of claim 29, wherein said strap holding member is movably mounted with a pivot member and said pivot member is pivotally mounted with respect to said lock to move said holding member between said release position and said locked position.

31. The strap lock body of claim 29, wherein said lock is operable to lock said pivot member when said pivot member moves said holding member to said locked position.

32. The strap lock body of claim 31, wherein said pivot member comprises engagement holes and said lock comprises respective engagement pins for engagement with said engagement holes.

33. The strap lock body of claim 30, wherein said pivot member, when said holding member is in said locked position, is positioned to prevent said post from escaping said post chamber.

34. A strap lock assembly, comprising:

a plurality of flexible straps each having a leading end and a trailing end; and a lock device comprising a first strap engagement portion capable of holding one part of one of said straps in position with respect to said lock device in a locked position thereof and releasing the one part in a release position thereof, a second strap engagement portion for engaging another part of the one of said flexible straps, and a lock capable of locking said first strap engagement portion in the locked position;

wherein said lock device can release the other part of said flexible strap from said second strap engagement portion when the one part of said strap is released so that the one of said straps can be replaced with another of said straps;

wherein said plurality of flexible straps have different lengths.

35. A strap lock comprising:

a flexible strap having a leading end and a trailing end; and a strap lock body comprising a pivot member pivoted on a lower member by a pivot and movable between an engagement position for engaging said flexible strap and an open position, and including:

a trailing end engagement portion on said lower member for engaging said trailing end of said flexible strap, a leading end engagement portion formed by said pivot member and said lower member such that said leading end can be engaged between said pivot member and said lower member when inserted there between and when said pivot member is pivoted to said engagement position, and a lock located at said pivot for locking said pivot member to said lower member in said engagement position.

36. The strap lock of claim 35, wherein said pivot, said lock and said leading end engagement portion are located at one end of said strap lock body, and said trailing end engagement portion is located at an opposite end of said strap lock body.

* * * * *